US006404996B1

(12) United States Patent
Mori et al.

(10) Patent No.: US 6,404,996 B1
(45) Date of Patent: Jun. 11, 2002

(54) ELECTROPHOTOGRAPHIC APPARATUS HAVING PLURAL IMAGE FORMING MODES, AND A PROCESS CARTRIDGE APPLIED TO SUCH ELECTROPHOTOGRAPHIC APPARATUS

(75) Inventors: Tomonori Mori, Numazu; Hisayoshi Kojima, Mishima; Kazunari Murayama, Shizuoka-ken; Kazufumi Muto, Susono, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/624,202

(22) Filed: Jul. 24, 2000

Related U.S. Application Data

(62) Division of application No. 09/280,578, filed on Mar. 30, 1999.

(30) Foreign Application Priority Data

| | | |
|---|---|---|
| Mar. 31, 1998 | (JP) | 10-105748 |
| Aug. 28, 1998 | (JP) | 10-273341 |
| Mar. 17, 1999 | (JP) | 11-071566 |

(51) Int. Cl.[7] ..... G03G 15/08

(52) U.S. Cl. ..... 399/24; 399/27

(58) Field of Search ..... 399/27, 35, 28, 399/60, 61, 360, 258, 120, 358; 347/170, 158; 222/DIG. 1

(56) References Cited

U.S. PATENT DOCUMENTS

| | | | | |
|---|---|---|---|---|
| 5,202,769 | A | 4/1993 | Suzuki | 358/300 |
| 5,235,383 | A | 8/1993 | Tada et al. | 355/200 |
| 5,249,026 | A | 9/1993 | Kojima | 355/327 |

(List continued on next page.)

FOREIGN PATENT DOCUMENTS

| | | |
|---|---|---|
| JP | 4-198951 | 7/1992 |
| JP | 4-338993 | 11/1992 |
| JP | 5-313434 | 11/1993 |
| JP | 6-324608 | 11/1994 |
| JP | 8-137336 | 5/1996 |
| JP | 10-039692 | 2/1998 |

OTHER PUBLICATIONS

Patent Abstracts of Japan, vol. 1998, No. 6, Apr. 30, 1998 (JP–10–039692).
Patent Abstracts of Japan, vol. 17, No. 187 (P–1520) Apr. 12, 1993 (JP–4–338993).
Patent Abstracts of Japan, vol. 16, No. 532 (P–1448), Oct. 30, 1992 (JP 4–198951).
Patent Abstracts of Japan, vol. 1995, No. 2, Mar. 31, 1995 (JP–6–324608).
Patent Abstracts of Japan, vol. 1996, No. 9, Sep. 30, 1996 (JP–8–137336).
Patent Abstracts of Japan, vol. 13, No. 185, May 2, 1989 (JP–1–013562).

*Primary Examiner*—Quana M. Grainger
(74) *Attorney, Agent, or Firm*—Fitzpatrick, Cella, Harper & Scinto

(57) ABSTRACT

A cartridge which is detachably mountable on an image forming apparatus is provided with non-volatile storing medium. In this non-volatile storing medium, a predetermined value is stored. The predetermined value is used for controlling the image forming apparatus together with the count value which is counted when forming images. The count value for counting images formed in a first image formation mode is different from the count value that is counted when forming images in a second image formation mode whose maximum amount of waste toner contained in a cleaning container is different from that of the first image mode. With the structure thus arranged, the number of printable sheets is made greater before the waste toner is filled in the cleaning container up to its limit, hence enabling the user to secure a longer period of time for preparing the cartridge.

20 Claims, 6 Drawing Sheets

U.S. PATENT DOCUMENTS 5,442,421 A 8/1995 Kojima ..... 355/211
5,471,284 A 11/1995 Fujii et al. ..... 355/210
5,497,220 A 3/1996 Inomata et al. ..... 355/245
5,521,693 A 5/1996 Kojima et al. ..... 355/326
5,797,067 A * 8/1998 Mitekura ..... 399/79
5,918,085 A 6/1999 Rollins et al. ..... 399/27
5,940,657 A 8/1999 Yokomori et al. ..... 399/119
5,950,049 A 9/1999 Yokomori et al. ..... 399/119
5,956,541 A 9/1999 Hoshika et al. ..... 399/24
5,963,759 A 10/1999 Kojima et al. ..... 399/111

* cited by examiner

ELECTROPHOTOGRAPHIC APPARATUS HAVING PLURAL IMAGE FORMING MODES, AND A PROCESS CARTRIDGE APPLIED TO SUCH ELECTROPHOTOGRAPHIC APPARATUS

This application is a division of application Ser. No. 09/280,578, filled Mar. 30, 1999.

BACKGROUND OF THE INVENTION

1. Field of the Invention

The present invention relates to an image forming apparatus of the electrophotography type or the electro-static recording type. The invention also relates to a cartridge used for the image forming apparatus, and a method for controlling such image forming apparatus as well.

More particularly, the invention relates to a cartridge provided with a container that contains toner cleaned off from the surface of an image bearing member that bears the toner. The invention also relates to an image forming apparatus, and a method for controlling the image forming apparatus, which comprises a storing step to store toner in the container.

2. Related Background Art

An image forming apparatus, such as a printer, forms latent images by exposing selectively or the image bearing member, which is uniformly charged by a charging device. Then, by a developing device, the latent images are visualized with the developer (toner), and the images visualized with the developer are transferred to a recording medium for image recording. After the transfer, the developer remaining on the image bearing member is removed by a cleaning blade to store it in the cleaning container. The next exposure is then performed by the image bearing member whose surface has been cleaned.

In recent years, it has been practiced that the image bearing member, the charging device, the developing device, the cleaning portion, the waste toner box, and others are put together into the integrated structure of a cartridge. As a result, the user can mount the cartridge on the apparatus main body so that parts of the image bearing member and the developer can be exchanged, and maintainance can be effected easier. Further, along with prolonging life of the image bearing member and increasing the printable sheet numbers, the developing device limited supply capability is arranged as an independent unit, and there are provided separately the developing cartridge, and the drum cartridge which is a process cartridge having the image bearing member as an image forming process means, the charging device, and the cleaning portion integrally. In this way, as in the case of the aforesaid process cartridge having the developing device and the image bearing member unitized therein, it is made easier to mount the drum cartridge on the apparatus main body, and also, it is made easier to maintain this type of cartridge. Furthermore, it is made possible to use these cartridges effectively, depending on the life of the respective main parts appropriately. For the drum cartridge, the waste toner cleaned off in the cleaning operation is stored in the cleaning container whose capacity is large enough to store it sufficiently during the life of the image bearing member. Then, the waste toner is removed when the drum cartridge should be replaced.

As an image forming apparatus of the kind, there is the one disclosed in the specification of Japanese Patent Application Laid-Open No. 10-039692. In accordance with such disclosure, an advance warning is given for replacement when the storage container that stores the cleaned-off waste toner is filled in it, and then, the printing is made executable in order to count the sheet numbers of print to be made. In this way, "full up" detection is made possible. After that, the operation of the apparatus main body is suspended when a predetermined number of the sheets is printed out.

However, the method disclosed in the publication of Japanese Patent Application Laid-Open No. 10-039692 is arranged to count the sheet numbers to be printed after the replacement warning has been given when the storage container is filled. For example, therefore, when a monoblack image, an image having a lower print ratio, which may bring about a smaller amount of waste toner, should be printed in a considerable number of sheets, there is a case where the operation of the apparatus main body is subjected to suspension eventually, irrespective of the condition in which any damage may be caused the main body even if printing is still admitted to continue.

SUMMARY OF THE INVENTION

It is an object of the invention to provide a cartridge capable of printing as many sheets as possible when forming images having a smaller amount of waste toner to be contained in a container, such as monoblack images and images having a lower printing ratio, and also, to provide an image forming apparatus, as well as a method for controlling such image forming apparatus.

It is another object of the invention to provide a method for controlling an image forming apparatus comprising: a first image forming step for forming a toner image on a first image bearing member in accordance with an image formation mode; a transferring step for transferring the toner image on the first image bearing member to a second image bearing member different from the first image bearing member; a cleaning step for cleaning the toner remaining on the surface of the first image bearing member after the transferring step; containing step a for containing the toner cleaned in the cleaning step in a container; and a controlling step for controlling the image forming apparatus in accordance with a predetermined value stored on a non-volatile storing medium detachably mountable on a main body of the image forming apparatus together with the container, wherein the predetermined value is used in the controlling step for controlling the image forming apparatus together with a first count value for counting in a first image formation mode, and a second count value, different from the first count value, for counting in a second image formation mode, and the maximum value of toner to be contained in the container when the image is formed in the first image formation mode, is different from the maximum value of toner to be contained in the container when the image is formed in the second image formation mode.

It is still another object of the invention to provide a method for controlling an image forming apparatus comprising: a first image forming step for forming a toner image on a first image bearing member in accordance with an image formation mode; transferring step for a transferring the toner image on the first image bearing member to a second image bearing member different from the first image bearing member; a cleaning step for cleaning the toner remaining on the surface of the first image bearing member after the transferring step; a containing step for containing the toner cleaned in the cleaning step in a container; detecting step for a detecting the amount of the toner contained in the container having arrived at a predetermined amount; and a controlling step for controlling the image forming apparatus in accordance with a predetermined value stored on non-volatile storing medium after the detecting step, wherein the predetermined value is used in the controlling step for controlling the image forming apparatus together with a first count value for counting in a first image formation mode, and a second count value, different from the first count value, for counting in a second image formation mode, and the maximum value of toner to be contained in the container for the image formation in the first image formation mode is different from the maximum value of toner to be contained in the container for the image formation in the second image formation mode.

It is a further object of the invention to provide a cartridge detachably mountable on an image forming apparatus comprising: a container for containing toner to be cleaned from the surface of an image bearing member for bearing toner thereon; and a non-volatile storing medium for storing the predetermined value for controlling the image forming apparatus, wherein the predetermined value stored on the non-volatile storing medium is the value used for controlling the image forming apparatus together with a first count value for counting in a first image formation mode, and a second count value, different from the first count value, for counting in a second image formation mode.

It is still a further object of the invention to provide a cartridge detachably mountable on an image forming apparatus comprising: a container for containing toner cleaned from a surface of an Image bearing member for bearing toner; and a non-volatile storing medium for storing a predetermined value for controlling the image forming apparatus, wherein the predetermined value stored on the non-volatile storing medium is used for controlling the image forming apparatus together with a count value for counting per color of toner used for an Image.

Other object of the present invention will be apparent in the following description.

DETAILED DESCRIPTION OF THE PREFERRED EMBODIMENTS

Hereinafter, in conjunction with the accompanying drawings, an image forming apparatus will be described in accordance with the present invention.

(First Embodiment)

The image forming apparatus of the present invention will be explained in the following description along the accompanied drawings.

(The Description of the Entire Body of the Image Forming Apparatus)

Figure 1:
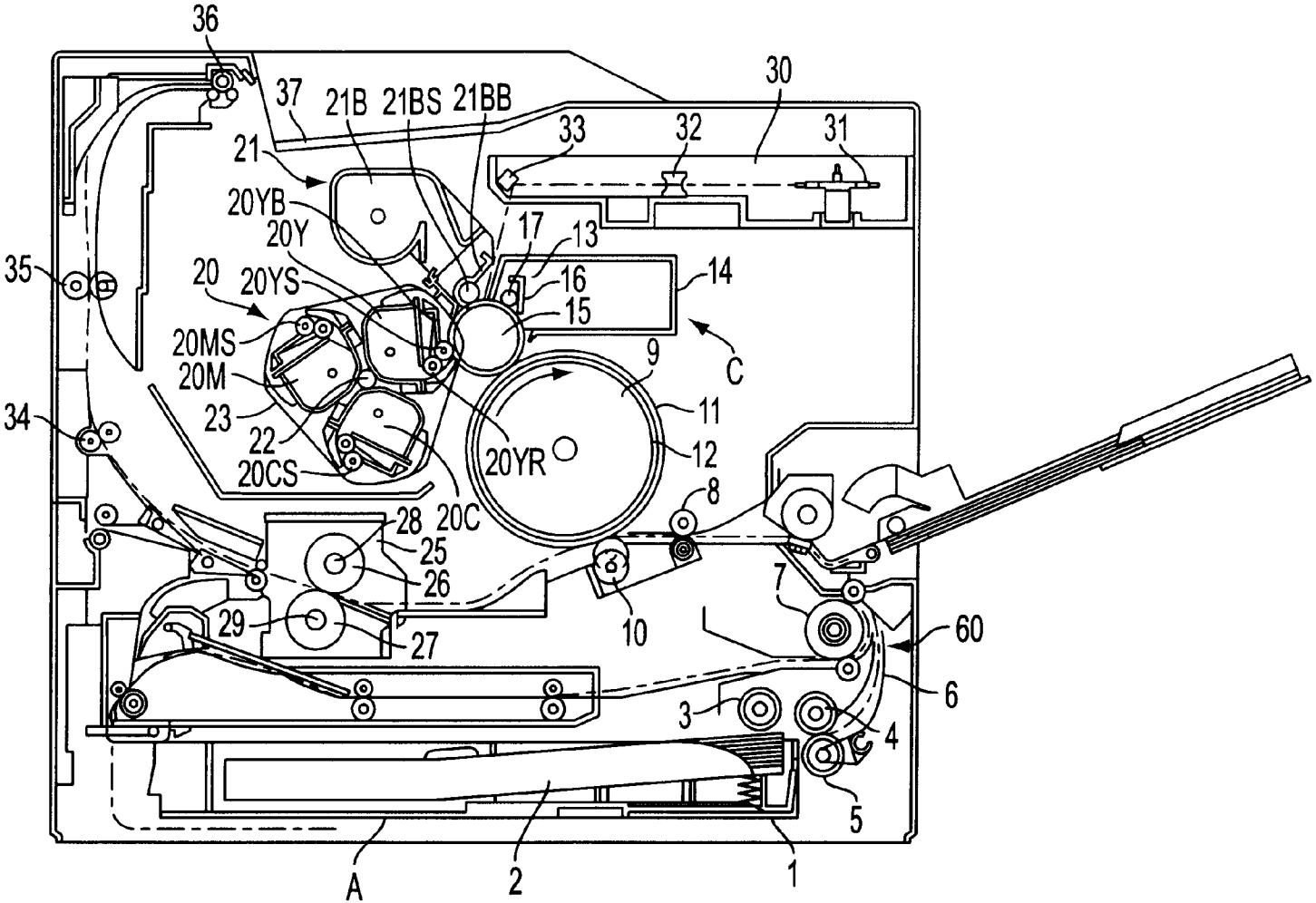
FIG. 1 is a view which illustrates the entire structure of a laser printer that serves as an image forming apparatus.

Now, at first, with reference to FIG. 1, a the brief description will be provided of the entire structure of the image forming apparatus.

FIG. 1 is a view which illustrates the entire structure of a laser printer which is one embodiment of the color image forming apparatus.

As shown in FIG. 1, the color laser printer comprises a drum type photosensitive body 15 serving as a first image bearing member which is rotative at a constant speed; developing means 20 and 21 formed by one fixed black developing device 21B and three rotative color developing devices 20Y, 20M, and 20C; an intermediate transfer body 9 serving as a second image bearing member which holds the multiply transferred color image developed by the developing means 20 and 21, and transfers the image further to the transfer material 2 serving as a third image bearing member, namely, a recording material which is supplied from the feeding portion 60. Then, the transfer material 2 on which color image is transferred is conveyed to the fixing portion 25 to fix the color image on the transfer material 2, and discharged to the discharge portion 37 installed on the upper surface of the printer .main body (the main body of the image forming apparatus) A by use of the discharge rollers 34, 35, and 36. The above-described rotative color developing devices 20Y, 20M, and 20C, and the fixed black developing device 21B are structured to be detachably mountable on the printer main body A individually. Also, the convey means is formed by the feeding portion 60 and the discharge rollers 34, 35, and 36.

Now, a the detailed description will be provided for each portion of the image forming apparatus in sequence.

(Image Bearing Member Unit)

The drum cartridge 13, which serves as the unit of a process cartridge, is integrally formed with the photosensitive body 15, and the cleaning container 14 of the cleaning device C which dually functions as the holder of the photosensitive body 15. The drum cartridge 13 is inserted from the mounting opening (not shown) provided for the printer main body A into the cartridge mounting portion, and supported detachably mountable on the mount guide (not shown) arranged In the interior of the cartridge mounting portion. Then, the structure is arranged to make the unit easily exchangeable in accordance with the life of the photosensitive body 15. The photosensitive body 15 of the present embodiment is structured with an aluminum cylinder whose diameter is approximately 60 mm with the organic photoconductive layer formed on the outer side thereof, and rotatively supported by the cleaning container 14. On the circumference of the photosensitive body 15, the cleaning blade 16 and primary charging means 17 are arranged. Also, the driving power of a driving motor is transmitted to one end of the photosensitive body l5, which is on the rear side of FIG. 1, so that the photosensitive body 15 can rotate counterclockwise in FIG. 1 corresponding to the image forming operation.

(Charging Means)

Charging means 17 uses a contact charging method in which a conductive roller is in contact with the photosensitive body 15. Voltage is applied to this conductive roller to cause the surface of the photosensitive body 15 to be electrostatically charged uniformly.

(Exposing Means)

The exposure on the photosensitive body 15 is made by the scanner portion 30. In other words, the laser diode (not shown) receives image signals, and irradiates a polygon mirror 31 with imaging beams in accordance with the image signals thus received. The polygon mirror 31 is rotated at a high speed by means of a scanner motor (not shown). The imaging beams reflected from the polygon mirror 31 are exposed selectively on the surface of the photosensitive body 15, which rotates at a constant speed, through the focusing lens 32 and the reflection mirror 33. As a result, electrostatic latent images are formed on the photosensitive body 15.

(Developing Means)

Developing means 20 and 21 are structured by three rotative developing devices 20Y, 20M, and 20C, and one black developing device 21B, which are arranged to visualize the electrostatic latent images and can develop by each of the colors, yellow, magenta, cyan, and black.

The black developing device 21B is a fixed developing device. Then a sleeve 21BS is arranged in a position to face the photosensitive body 15 with a fine gap (approximately 300 $\mu$m) with the photosensitive body 15. Then, the images are visualized on the photosensitive body 15 by black toner.

In the black developing device 21B, the toner in the container is transferred by a carrying mechanism (not shown) and coated in a thin layer on the circumference of the sleeve 21BS that rotates clockwise in FIG. 1 by the coating blade 21BB which is in contact under pressure with the circumference of the sleeve 21BS, and the toner is charged (by frictional charging). Also, the developing bias is applied to the sleeve 21BS so as to perform the toner development corresponding to the electrostatic latent images formed on the photosensitive body 15.

The three rotational developing devices 20Y, 20M, and 20C are detachably mountable on the developing rotary 23, respectively, centering on the shaft 22, and when images are formed, each of the developing devices 20Y, 20M, and 20C shifts rotatively centering on the shaft 22 in a state that each of them is supported by the developing rotary 23. Then, each of the specific developing devices 20Y,.20M, and 20C comes to a stop in a position to face the photosensitive body 15. Further, after the developing sleeves 20YS, 20MS, and 20CS are positioned to face the photosensitive body 15 with the fine gap (300 $\mu$m approximately), the visualized images are formed corresponding to the electrostatic latent images on the photosensitive body 15. When the color images are formed, the developing rotary member 23 rotates per a rotation of the intermediate transfer body 9 thereby the developing process is executed in order of the yellow developing device 20Y, the magenta developing device 20M, the cyan developing device 20C, and then, the black developing device 20B.

FIG. 1 is a view which shows the state where the yellow rotational developing device 20Y is positioned and made stationary at the position to face the drum cartridge 13. In the yellow developing device 20Y, the toner in the container is carried to the coating roller 20YR by a carrier mechanism (not shown) and coated in a thin layer on the circumference of the sleeve 20YS that rotates clockwise in FIG. 1 by the coating roller 20YR and the coating blade 21YB, which is in contact under pressure with the circumferences of the sleeve 20YS and the toner is charged (by frictional charging). Also, the developing bias is applied to the sleeve 20YS opposing the photosensitive body 15 on which the latent images are formed so as to perform the toner development corresponding to the latent images. With respect to the magenta developing device 20M and the cyan developing device 20C, the toner development is performed in the same mechanism as described above.

Each of the sleeves 20YS, 2OMS, and 20CS of the rotative developing devices 20Y, 20M, and 20C is connected with the high-voltage supply-sources for each of the color developing device and driving means (neither of them shown) mounted in the printer main body A when each of the developing devices is rotatively shifted. Then, voltage is applied, and the driving means is connected per each color development.

(Intermediate transfer body)

The intermediate transfer body 9 rotates clockwise in FIG. 1 in synchronism with the circumferential speed of the photosensitive body 15 in order to receive up to four times the multiple transfer of each of the toner images (each image in four colors, Y, M, C, and B) formed on the photosensitive body 15, which are visualized by the developing devices 20Y, 20M, 20C, respectively, when the intermediate transfer portion operates to form color images. Also, the intermediate transfer body 9, which has received the multiple transfer, conveys the transfer material 2 by pinching it in cooperation with the transfer roller 10 to which voltage is applied, thus transferring the toner image in each color on the intermediate transfer body 9 to the transfer material 2 multiply and simultaneously.

In accordance with the present embodiment, the intermediate transfer body 9 is structured with an aluminum cylinder 12 having a diameter of 180 mm and an elastic layer 11 of a medium-resistance sponge, a medium-resistance rubber, or the like, that covers the outer circumference thereof. The intermediate transfer body 9 is rotatively supported, and rotates when receiving the driving power through the gear (not shown) integrally fixed thereto.

(Cleaning Device)

The cleaning device C is provided for cleaning the toner remaining on the photosensitive body 15 after the toner visualized by the developing means 20 and 21, is transferred to the intermediate transfer body 9. The waste toner thus cleaned off is stored in the cleaning container 14. Here, it is arranged that the amount of the waste toner thus stored in the cleaning container 14 is not allowed to reach the full-up limit of the cleaning container 14 earlier than the life of the photosensitive body 15. Therefore, it is possible to exchange the cleaning containers 14 simultaneously with the photosensitive body 15 integrally which should be replaced due to its reaching the end of its life. The structure of the cleaning container 14 will be described later in detail.

(Sheet feeding portion)

The sheet feeding portion 60 is a unit to convey the transfer material 2 to the transfer portion, and mainly comprises a cassette 1 having plural sheets of the transfer material 2; a sheet feed roller 3; a feed roller 4, a retard roller 5 for preventing double feed; a sheet feed guide 6; and a resistration roller 8. When images are formed, the sheet feed roller 3 is driven to rotate in accordance with the image forming operation and separate the transfer material 2 in the sheet supply cassette 1, one by one, for feeding. At the same time, the sheet thus fed is guided by the sheet feed guide 6 and carried up to the resistration roller 8 through the convey roller 7. During the image forming operation, the resistration roller 8 executes the non-rotative operation which enables the transfer material 2 to be on standby stationarily, and the rotative operation that enables the transfer material 2 to be conveyed to the intermediate transfer body 9 in accordance with a specific sequence. The resistration roller 8 also alignes the transfer material 2 with the images in the transfer process, which is the next processing step.

(Transfer Portion)

The transfer portion is formed by the transfer roller 10, which is swingable.

The transfer roller 10 is formed by a metallic shaft wrapped with a medium-resistance foam elastic element, which can shift vertically in FIG. 1, and has a drive. During the formation of four color toner images on the intermediate transfer body 9, that is, when the intermediate transfer body 9 rotates several times, the transfer roller indicated by solid line in FIG. 1, is in the lower position so that it parts from the intermediate transfer body 9. After the four color toner images are formed on the intermediate transfer body 9, the transfer roller 10 shifts to the upper position indicated by the fine line in FIG. 1 by a cam member (not shown) in the timing that matches with the transfer of the color images to the transfer material 2. In other words, the transfer roller 10 is pressed to the intermediate transfer body 9 through the transfer material 2 under a given pressure. At this juncture, the bias is applied to the transfer roller 10 simultaneously to transfer the toner images on the intermediate transfer body 9 to the transfer material 2. Here, since the intermediate transfer body 9 and the transfer roller 10 are driven individually, the transfer material 2 pinched by them is conveyed in the left direction in FIG. 1 at the same time while the transfer process is executed, and conveyed to the fixing device 25, which performs the next process.

(Fixing Portion)

The fixing device 25 fixes the toner images which are formed by the developing means.20 and 21 described earlier and transferred to the transfer material 2 through the intermediate transfer body 9. As shown in FIG. 1, the fixing device 25 has the fixing roller 26 that gives heat to the transfer material 2, and the pressure roller 27 that presses the transfer material 2 to be in contact with the fixing roller 26. Each of the rollers 26 and 27 is a hollow roller, having hearts 28 and 29 in it, respectively. Then, the structure is arranged so that each of them is driven to rotate, and to convey the transfer material 2 at the same time.

In other words, the transfer material 2 that bears the toner images is conveyed by the fixing roller 26 and the pressure roller 27, and at the same time, the transfer material 2 is given both heat and pressure, hence fixing toner on the transfer material 2.

(Cleaning Container)

The details of the cleaning container 14 will be described in conjunction with FIG. 2 and FIG. 3.

In the cleaning container 14, a partition member 40 is provided for the interior of the container main body 14*a* to divide it into a cleaning chamber 38 and a toner storage 39 that functions as a storage container to store waste toner. Thus, it is arranged to prevent the waste toner from flowing reversely, and producing any adverse effect on the cleaning operation.

Figure 3:
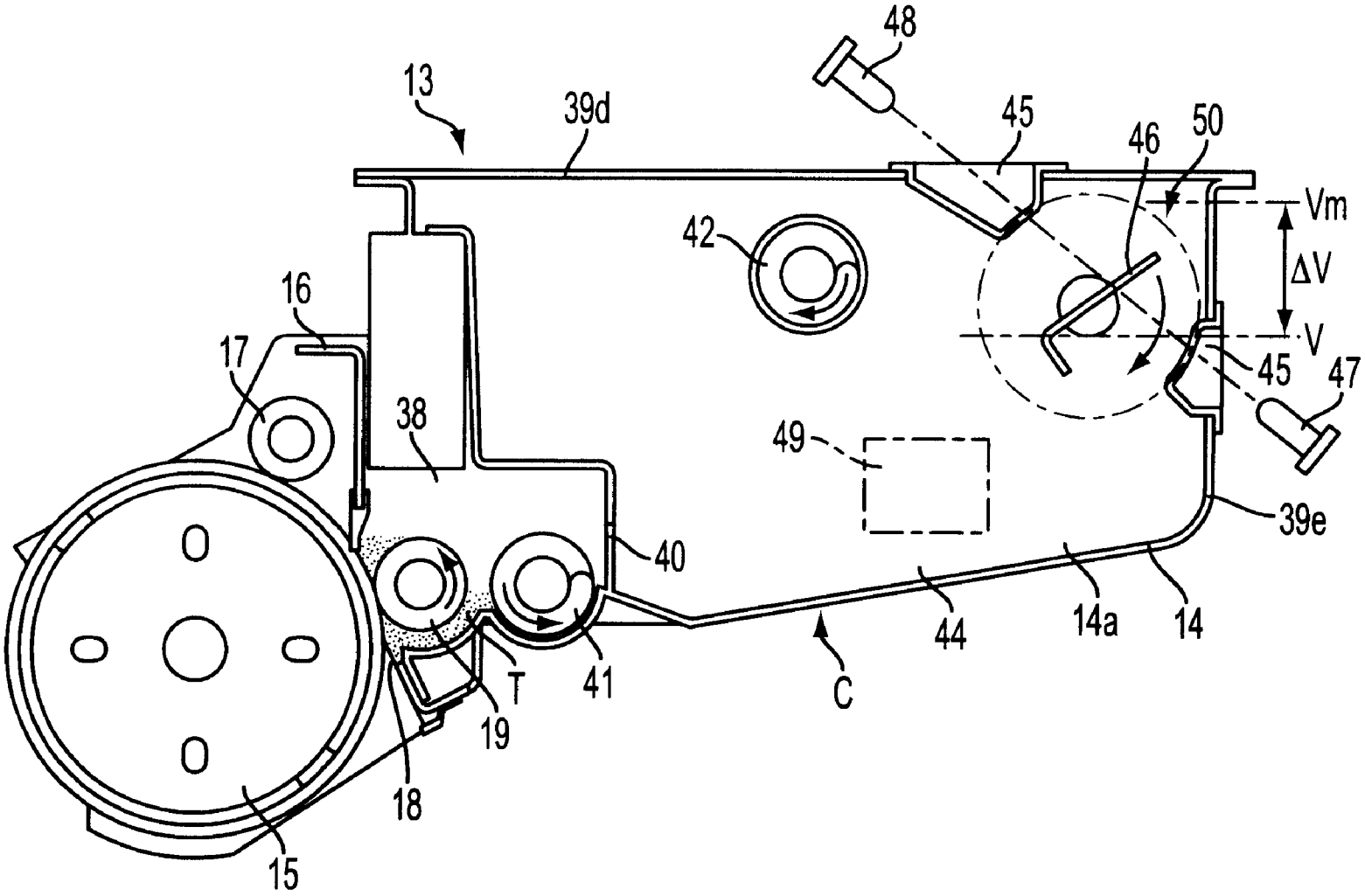
FIG. 3 is a vertically sectional view which shows the drum cartridge, observed from front.
Figure 4:
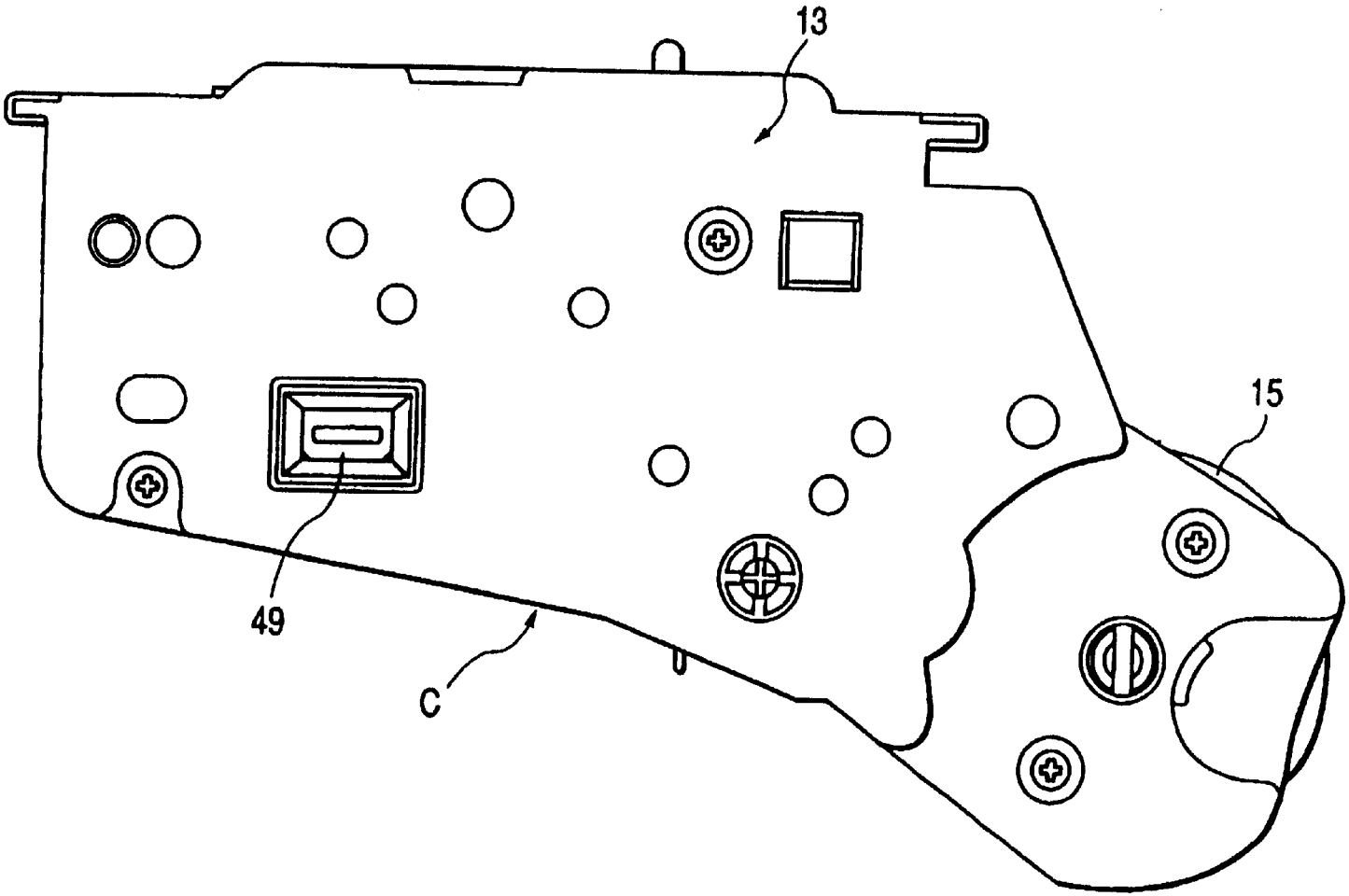
FIG. 4 is a front view which shows the drum cartridge, observed from behind.

The cleaning of the toner remaining on the surface of the photosensitive body 15 is effectuated in the cleaning chamber 38 by use of the cleaning blade 16 and the cleaning roller 19 which serve as cleaning means (see FIG. 3). The residual toner on the surface of the photosensitive body 15 enters the cleaning chamber 38 through the toner receiving sheet 18. Then, at first, the residual toner is scraped off by the cleaning roller 19, and then, by the cleaning blade 16.

The waste toner T, which is cleaned by the cleaning roller 19 and the cleaning blade 16 and accumulated in the cleaning chamber 38, is fed to the screw 41 arranged behind them by the cleaning roller 19. With the rotation of this screw 41, the waste toner is carried in the longitudinal direction of the image bearing member 15 in parallel therewith, and accumulated in the toner accumulation chamber 39. Here, in accordance with the present embodiment, the toner remaining on the surface of the photosensitive body 15 is defined as the "residual toner", and the toner that has been cleaned off by the aforesaid cleaning means is defined as the "waste toner".

Now, when the waste toner T that has been carried and accumulated in the toner accumulation chamber 39 reaches the position of the screw 42 arranged in the toner accumulation chamber 39, the waste toner is carried in the toner accumulation chamber 39 in the direction opposite to the carrying direction of the waste toner by the screw 41 in the cleaning chamber 38, and stored in the full tank detection chamber 44, which will be described later (see FIG. 2 and FIG. 3).

Figure 2:
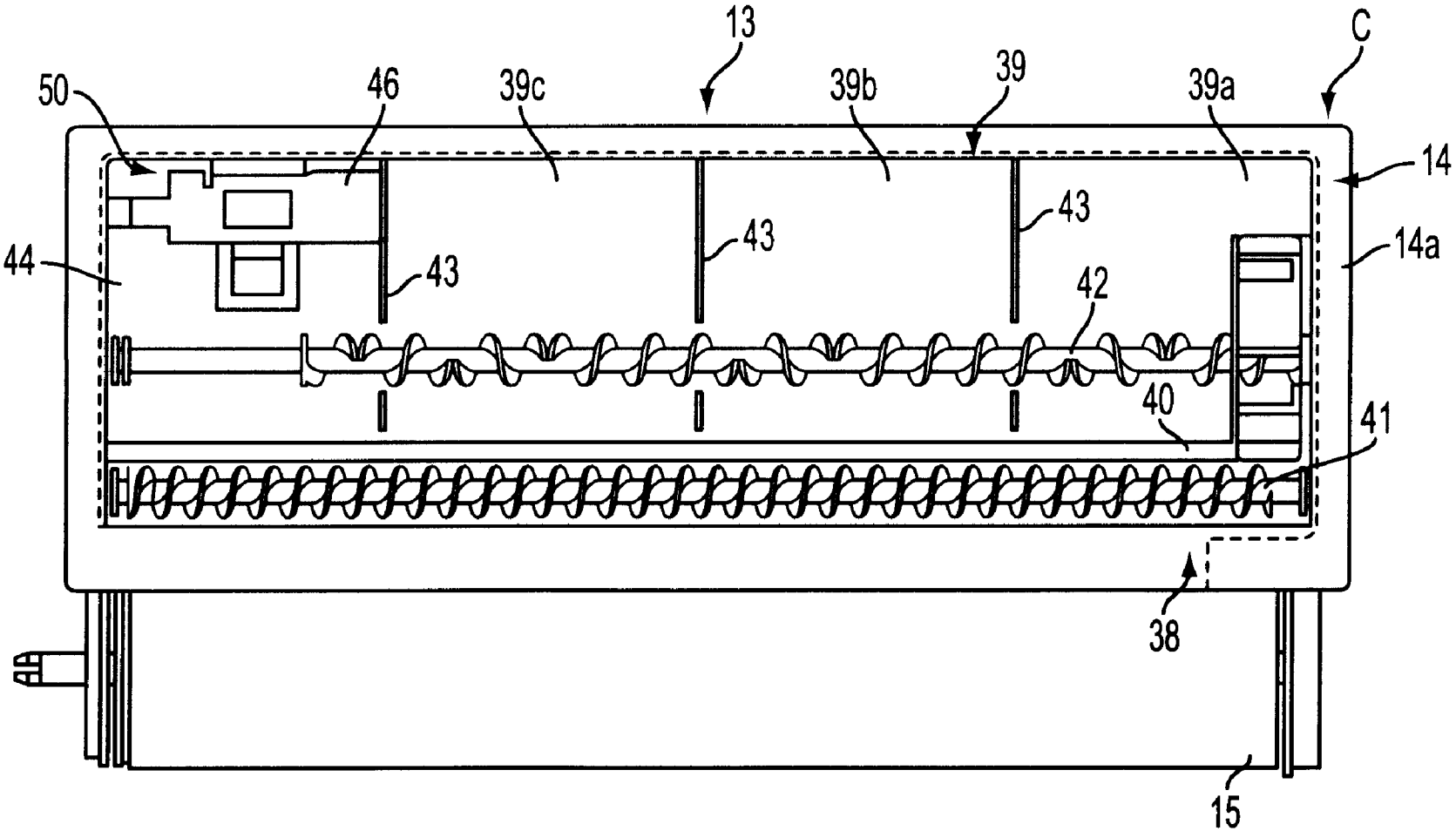
FIG. 2 is a horizontally sectional view which shows a drum cartridge, observed from above.

As shown in FIG. 2, the interior of the toner accumulation chamber 39 is divided into four smaller chambers by means of plural ribs 43 that partition the waste toner chamber, each extending vertically in the longitudinal direction. Of these smaller chambers, one chamber on the lowermost stream in the carrying direction of the waste toner by the screw 42 is arranged to be the full tank detection chamber 44 where the waste toner full tank detection mechanism 50 is arranged as means for detecting the full-up condition of the waste toner. In this manner, it is made possible to prevent any erroneous detection of the full-up condition that may take place if a large amount of the waste toner T is biased in the toner accumulation chamber 39. The waste toner full-up condition detecting mechanism is a mechanism that optically detects that the amount of the stored toner has reached a predetermined amount. The detailed description thereof will follow.

(Waste Toner Full-Up Condition Detecting Mechanism)

The detection of the waste toner is carried out optically by a waste toner full-up condition detecting mechanism. The light transparent windows 45 are arranged to face each other on the upper surface 39*d* and the back side 39*e* of the toner accumulation chamber 39, respectively. Then, a window cleaning blade 46 is arranged between the light transparent windows 45, which rotates to wipe off the waste toner stains from the light transparent windows 45. The presence and absence of the waste toner is detected by allowing light to be transmitted through the full tank detection chamber 44 by the light emitting element 47 and the light receiving element 48 arranged in the printer main body A or integrally arranged with the cleaning container 14. When the waste toner T accumulated in the full tank detection chamber 44 arrives at the 10 position of the light transparent windows 45, the light beam is cut off by the waste toner T to make it impossible for the light receiving element 48 to detect the beam. Then, the control circuit (CPU) 51 in the printer main body (see FIG. 5) determines the full tank condition. This full-up information is indicated on the operation panel (not shown) provided for the printer main body A or on the screen of the display of the computer, hence prompting the user to replace drum cartridges 13.

At this juncture, the toner accumulation chamber 39 has not been filled up completely with the waste toner as yet. There is still a slight room for the waste toner to be accumulated. Therefore, the user can continue his printing operation. In other words, as shown at V in FIG. 3, the stored amount of the waste toner in the toner accumulation chamber 39 at this time has not reached the amount of storage limit of the waste toner at Vm in the toner accumulation chamber 39 shown in FIG. 3. Here, there is still the storage capacity of the waste toner, $\Delta V$ (=Vm−V) in the toner accumulation chamber 39 before the storage V reaches the storage limit Vm of the waste toner.

(The Process of Image Forming Operation After the Full Tank Detection of the Waste Toner)

Now, a the description will be provided of the process of image forming operation after the full tank detection of the waste toner in accordance with the present embodiment.

From the standpoint of the user, it should be desirable for him to be able to continue printing until he is prepared to replace the drum cartridges 13 after he has received the warning as to the full tank condition of the waste toner. Therefore, it is preferable to arrange printing (forming images) on the transfer material 2 in an appropriate amount corresponding to the waste toner storable amount of ΔV described above. Then, the larger this appropriate amount, the better.

As described above, if it is arranged to be able to print after the detection of the full tank condition of the waste toner, the user should be prevented from using erroneously the drum cartridge 13 whose cleaning container 14 has been filled with the waste toner completely.

Also, in consideration of the fact that the drum cartridge 13 is made attachable and detachable, it is desirable to arrange that the information, which is obtained after the waste toner full tank detection is made, should not be lost even if the power-supply of the printer main body is turned off.

Also, the waste toner storable amount ΔV in the cleaning container 14, after the waste toner full tank detection is made, is determined to a certain extent by 10 the arrangement condition of the waste toner full tank detecting mechanism 50 arranged in the cleaning container 14.

Therefore, in accordance with the present embodiment, it is made possible to arrange the structure so that predetermined numbers of transfer material 2 are still printable after the user is notified of the detection of the waste toner full tank condition. In this way, the user can prepare for the replacement of the drum cartridges after he becomes aware of the full tank condition of the waste toner. After that, the drum cartridge 13 is made no longer usable. Also, the structure is arranged to store a threshold value on a non-volatile storage medium as storing means provided for the drum cartridge 13, which is set in order to make the cleaning device C or the drum cartridge 13 no longer usable.

Also, in a case where several kinds of print modes (image forming modes) having different print processes are mixed as a color printing apparatus, the sheet numbers of the image formation can be increased as much as possible by arranging the counting method changeable for the sheet numbers of the image formation on the transfer material 2 in accordance with the printing modes.

Here, a the description thereof will be provided further in detail.

Figure 5:
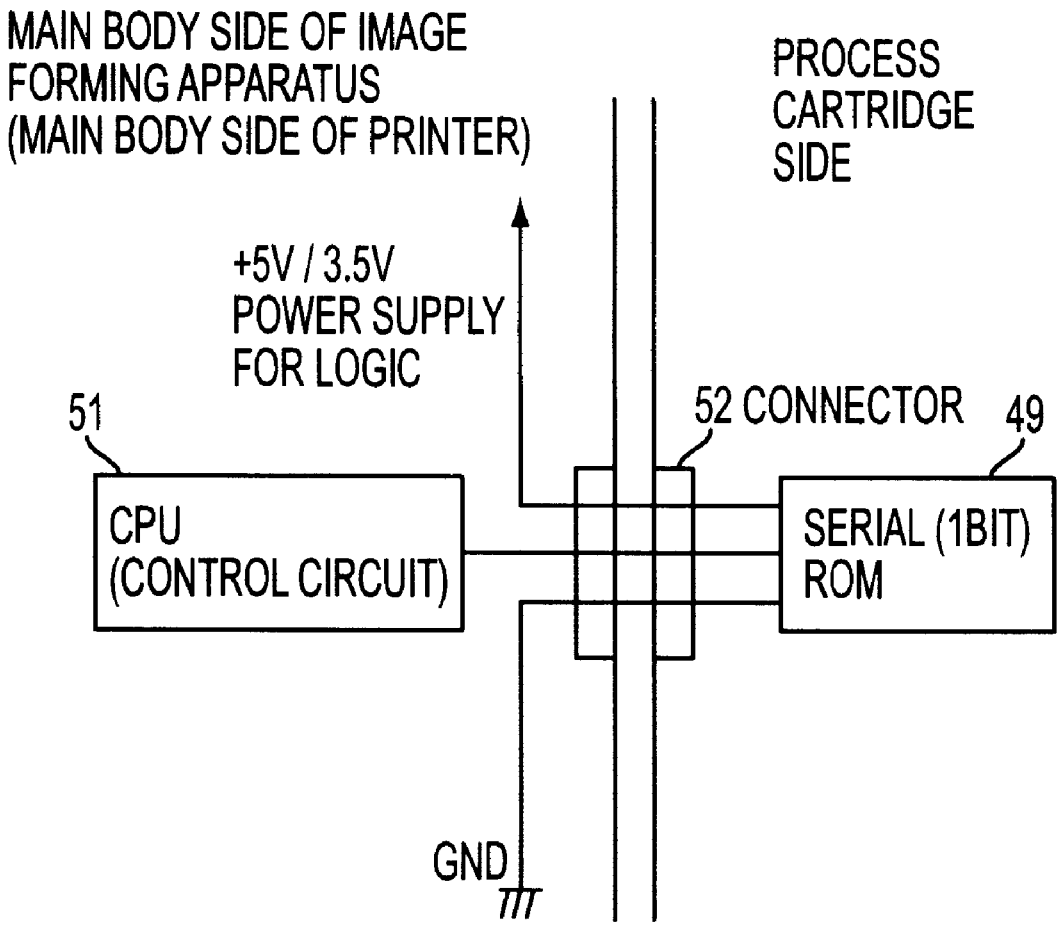
FIG. 5 is a structural block diagram which shows the coupling relationship between the control circuit on the main body side of the image forming apparatus and the cartridge ROM on the process cartridge side.

As shown in FIG. 5, it is arranged to store the information of the sheet count threshold value of the transfer material 2 to be printed after the full tank detection in advance on storing means, such as the drum cartridge ROM (read-only memory) (a serial ROM) 49 provided for the drum cartridge, which can be connected to exchange the transmission of information through the control circuit 5 on the printer main body A side and the connector 52.

Also, the count-up value should be added after the waste toner full tank detection mechanism 50 has detected a predetermined storage amount V of the waste toner. The count-up value is set by use of the storable amount ΔV of the waste toner in the cleaning container 14 before the cleaning device C or the drum cartridge 13 becomes no longer usable, since the waste toner full tank detection mechanism. 50 has detected the. waste toner storage amount V, as well as by use of the value of the waste toner amount which is stored in the cleaning container 14 per printing operation of the printer.

To briefly describe such a setting method, the actually measured value is obtained with respect to the waste toner amount that is discharged per printing. Then, the printable sheet numbers are estimated. In other words, the count-up value is set on the basis of the waste toner storable amount ΔV, and the estimated maximum value of each waste toner amount of several kinds of printing modes. In this way, it becomes possible to print on the maximum sheet numbers within the limited storage amount of the waste toner.

Now, hereunder, the counting method of the transfer material 2 after the full tank detection will be described in detail, while quoting the predetermined numeral values.

Here, it is assumed that:

the maximum waste toner amount of full color print is: 0.1 g /image the maximum waste toner amount of monoblack print is: 0.05 g /image where the image is: one image per print operation, and one full color sheet: four images, because it requires four printing operations each for yellow, magenta, cyan, and black; and one monoblack sheet is one image. Then, given the waste toner storable amount ΔV as 150 [g] before the cleaning device C is filled with the waste toner and its function is no longer guaranteed its function since the waste toner storage amount V has been detected by the waste toner full tank detection mechanism 50, the printable sheet numbers for the three kinds of printing modes, that is, a full color, a monoblack, and a full color mixed with monoblack are as follows during such period of time:

Full color: 375 [sheets]

Monoblack: 3,000 [sheets]

Full color mixed with monoblack: 508 [sheets]

(where the full color : the monoblack=7:3) On the basis of the results mentioned above, it is assumed that the counting method of the printable sheet numbers are as follows after the waste toner storage amount V has been detected by the waste toner full tank detection mechanism 50:

Full color : 3 [counts/image];

Monoblack : 7 [counts/image]. Also, the threshold value set for counting the transfer materials 2, which makes the cleaning device C or the drum cartridge no long usable, is assumed to be 4,200 [counts].

Figure 6:
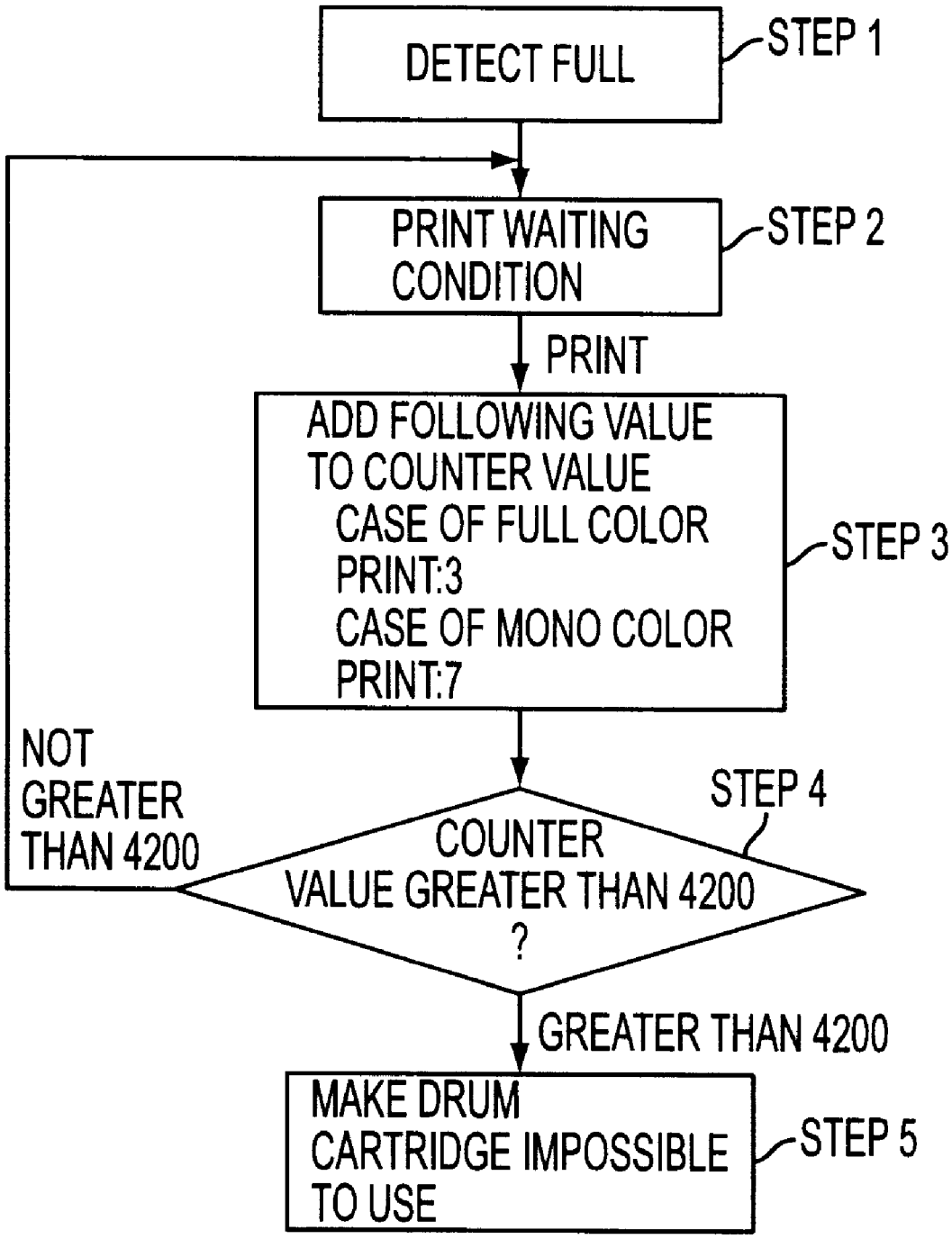
FIG. 6 is a flowchart which shows the method for detecting the waste toner full-up amount in accordance with the present embodiment.

Now, in conjunction with FIG. 6, a the description will be provided of a flowchart of the waste toner full tank detection method for the full-color and mono-color prints.

At first, after the waste toner full tank condition is detected by the waste toner full tank detection mechanism 50 of the control circuit 51 on the printer main body side (step 1), the printing is on standby (step 2) to make it possible to print on the transfer material 2 by use of the printer. Then, if the printing is executed in the full-color mode, the 3 [counts/image] is added. If the printing is executed in the mono-color mode, the 7 [counts/image] is added (step 3). The result of the addition (the integration of the counted values) is compared with the count threshold value (4,200 [counts]) one after another (step 4). When the integrated value becomes identical to the threshold value, the control is effectuated to disable the use of the cleaning device C or the drum cartridge (step 5). In other words, the image forming operation of the image forming apparatus is suspended.

The number of the printed sheets and the maximum amount of the waste toner are indicated on the following table when the printing is executed continuously in the same print mode.

Further, the number of the printed sheets and the maximum amount of the waste toner are indicated likewise when the full-color mode and the mono-color mode are mixed in use with the ratio of the printed sheet numbers being the full-color: the mono-color=7:3 before the counted values arrive at the threshold value of 4,200.

TABLE

| Print mode | Printed sheet numbers [sheet] | Maximum waste developer amount [g] |
|---|---|---|
| Only full-color | 350 | 140 |
| Only monoblack | 600 | 30 |
| Mixture of Full and Monoblack | 400 | 118 |

As is clear from the above table, the maximum amount of the waste toner is not allowed to exceed the waste toner storable amount ΔV of the cleaning container 14. After the full tank warning is given, the user can print in an appropriate amount until he is prepared to replace the drum cartridges. At the same time, it becomes possible to prevent the user from erroneously using the drum cartridge having the waste toner filled up to its limit.

As described above, in accordance with the present embodiment, a large amount of the waste toner is accumulated in the cleaning container 14 of a longer life drum cartridge 13. Then, when the waste toner reaches the waste toner storage amount V, full tank detection is made possible by the waste full tank detection mechanism 50. In this way, the user is notified of the full tank detection so as to prompt him to replace the cartridges. Then, when the integrated counting value of the printed sheets of the transfer material 2 becomes identical to the threshold value after having printed several hundreds sheets of transfer material 2, the cleaning device C or the drum cartridge 13 is made no longer usable for safety.

As a result, after being notified of the waste toner full tank warning, the user is still able to obtain a period of time for him to be able to prepare the cartridge before the use of the cleaning device C or the drum cartridge 13 is disabled.

Also, the count-up value is added per printing operation after the waste toner storage amount V is detected by the waste toner full tank detection mechanism 50. The count-up value is set on the basis of the waste toner storable amount ΔV, and the estimated maximum value of the waste toner amount of each print mode. Therefore, it becomes possible to print only the printable sheet numbers corresponding to each of the print modes. In other words, if a printing operation is executed in the mode that may result in only a smaller amount of the waste toner, it is possible to print on more sheets than the one which is executed in the mode that may bring about a larger amount of the waste toner. The user is then able to secure more time for the preparation of his next move.

Thus, it becomes possible to avoid creating a surplus or shortage of the printable sheet numbers of the transfer material after the full tank detection even for the several kinds of print modes having different print processes by selecting appropriately a desired counting method corresponding to each of such several kinds of print modes that require different print processes. In this way, print is possible in an appropriate amount in accordance with the waste toner storable amount ΔV.

Also, the integrated value of the counted values, which serves as information regarding the printed sheet numbers of the transfer material 2 subsequent to the full tank detection having been actuated, and the count threshold value, which is set to disable the use of the cleaning device C or the drum cartridge 13, are stored on a non-volatile storage means provided for the dram cartridge 13. In other words, since the information inherent to the drum cartridge is kept on the non-volatile storage means, it is possible to print after the full tank detection has been made even if the user turns off the power-supply of the printer main body A or if he removes the drum cartridge 13 from the printer main body A and uses it on that of some other printer, and only if the counted value reaches the threshold value, the use thereof becomes disabled, hence preventing the drum cartridge from being used once the waste toner is filled up to its limit.

(Second Embodiment).

In consideration of the characteristics of a printer, the present embodiment exemplifies a counting method in a case where only monoblack printing occurs more intentionally in the period from the full tank detection to the drum cartridge becoming no longer usable.

Now, hereunder, a detailed description will be provided of the counting method for determining the print sheet numbers after the full-up condition has been detected, while quoting the predetermined numeral values.

For example, if the count-up value is assumed to be as follows in a case where it is desired to intentionally print only the monoblack more in consideration of the characteristics of the printer:

Full color : 1 [count/image]

Monoblack : 1 [count/image], and also, if it is assumed that the count threshold value at which the drum cartridge is made no longer usable is 1,400 [counts], the print sheet numbers during this period are as follows:

| Print Mode | Print Sheet Numbers [sheet] |
|---|---|
| Only full color | 350 |
| Only monoblack | 1,400 |
| Full-color and monoblack mixture | 450 |

In the case of the full-color and monoblack mixture, the print sheet numbers are the total of such numbers obtainable until the counted value reaches 1,400 with the ratio of the printed sheet numbers of:

Full-color mode : monoblack mode=7:3

As described above, with the adoption of this counting method, it is possible to obtain the same effect as in the first embodiment with respect to the print sheet numbers even when it is desired to intentionally print only the monoblack more before the drum cartridge 13 becomes no longer usable after the full-up condition has been detected.

(Other Embodiments)

For the above embodiments, a description has been provided of the image forming apparatus provided with the adoption of the monoblack mode, and the full-color mode in which images are formed by use of toner of four colors. However, besides the two-mode apparatus, the present invention is suitably applicable to an image forming apparatus having the print mode of two-color images and three-color images.

Since the two-color image printing mode requires only the two-time image formation or the three-color image printing mode requires only the three-time image formation, the integrated value of the counted ones is lower than that of the full color printing mode which requires the four-time image formation. Consequently, the printable numbers are increased before the threshold value is reached.

Also, for the above embodiments, a description has been provided of an image forming apparatus having the print modes which are different depending on the kinds and numbers of colors. However, the present invention is suitably applicable to an image forming apparatus having count values which are different, depending on the line image mode that forms line images and the photographic image mode that forms photographic images.

With a change of the count values to be made corresponding to the line images or the photographic images as described above, it becomes possible for the user to secure the longer period of preparation depending on the image formation modes to be set. Here, the maximum amount of the waste toner is smaller for the line images than the photographic images. Therefore, the printable number of sheets is more for the formation of line images than that of the photographic images. The user can secure the longer period accordingly to prepare the cartridge for his next move.

Also, in order to prolong the preparation period for the user, it may be possible to change the count values in accordance with the print ratio (the ratio of the printed area to the background area of the recording material). For example, if the print ratio is 0%, "0" is counted. For 1% to 40% "1" is counted. If the print ratio is 41% or more, the number greater than "1" is counted. (The larger the print ratio, the more the amount of the waste toner is increased. Thus, the count value becomes greater accordingly.) In this way, by using the count value corresponding to the print ratio it becomes possible to print almost up to the full-up state of the waste toner in the cleaning container. Thus, a longer period of the cartridge preparation can be secured for the user, hence facilitating his replacement operation still more.

In this respect, for the image formation modes, such as the line image mode, and the photographic image mode, the print ratio of each image can be determined on the basis of the image signals given to the laser diode.

Also, for the above embodiments, a description has been provided of the case where the counting is performed per image. However, it may be possible to count the counted values per recording material. In this case, however, the counted value of each image formation mode is determined on the basis of the difference in the maximum amount of the waste toner for each of the modes. Therefore, the resultant values are different depending on the image formation modes. The counted value can be changed in accordance with the size or area of the recording material, for example, the counted value is set as "1" in a first image formation mode where the image is formed on the. recording material of A4 size, and the counted value. is set as "2" in a second image formation mode where the image is formed on the recording material of A3 size, or the like.

As a result, the present invention makes it possible to estimate the amount of the waste toner more reliably, and to provide a longer preparation period for the user than when the counting is performed uniformly per "1" per recording material as disclosed in the specification of Japanese Patent Application Laid-Open No. 10-039692, because by the present invention, a first count value is counted for a first image formation mode, and a second count value, which is different from the first count value, is counted for a second image formation mode, which is different from the first image formation mode.

Here, the increment method has been described as the counting method so far. However, the present invention may adopt the decrement method as well. For example, from the count threshold value, each counted value is subtracted in accordance with the image formation mode currently in use, and if the resultant value is greater than "0", the printing is considered possible (ready to print), while if it becomes identical to "0", the image forming operation should be suspended.

In this respect, a description has been provided of the image formation apparatus having the threshold value of the counted values which is stored on the non-volatile storing medium detachably mountable together with the cleaning container serving as the container to store the waste toner. It may be possible to store the threshold value of the counted values on the non-volatile storing medium provided for the printer main body A.

On the non-volatile storing medium which is detachably mountable together with the cleaning container, it should be good enough to store a predetermined value which is used for determining the accumulated amount of the toner in the cleaning container or the sheet numbers that still make the image formation possible.

Also, the present invention is suitably applicable to the image forming apparatus of the electronic photographing type or the electrostatic-recording type, which is structured to mount the photosensitive body 15 and the cleaning means (cleaning device C) that directly acts upon it, among some others, but does not adopt the mode of using the process cartridge (drum cartridge 13).

Also, as the photosensitive body 15 of the process cartridge (drum cartridge 13), there are the following, for example: at first, for the photosensitive portion, an optical conductor is used. As the optical conductor, there are amorphous silicon, amorphous selenium, zinc oxide, titanium oxide, and organic optical conductor (OPC), and some others. Also, for the configuration in which the photosensitive body is installed, there is used the drum type or the belt type, for example. For the drum type photosensitive body, the optical conductor is deposited or coated on the cylinder formed by aluminum alloy or the like, for example.

Also, the structure of charging means 17, the so-called contact-charging method is used for the embodiments described above. However, it is of course possible to use a conventional structure in which a metallic shield, such as aluminum, is provided on the three circumferences of tungsten wires, and then, a high voltage is applied to the tungsten wires to generate positive and negative ions which are allowed to move to the surface of the photosensitive body in order to charge the surface of the photosensitive body uniformly.

In this respect, as the aforesaid charging means, it may be possible to adopt the blade type (charging blade), the block type, the rod type, the wire type, or the like other than the roller type described above.

Also, as cleaning means for cleaning the toner remaining on the photosensitive body, it may be possible to form the cleaning means by use of the blade, the fur brash, the magnetic brash, or the like.

Also, the aforesaid process cartridge (drum cartridge 13) is provided with the photosensitive body and the charging means that acts upon on it with the exception of developing means, and the cleaning means. Besides the one embodying the invention as described above, there is a cartridge having the photosensitive body and cleaning means integrally formed therein, which is made detachably mountable on the image forming apparatus main body, among some others.

Further, for the above embodiments, a description has been provided of an image forming apparatus that transfers toner images to a recording material through the intermediate transfer body. However, the present invention is suitably applicable to a system in which the intermediate transfer body is excepted from the image forming apparatus of FIG. 1, namely the image forming apparatus which transfers the toner images on the photosensitive body directly to a recording material without any intervention of the intermediate transfer body.

Also, for the above embodiments, a description has been provided of the image formation apparatus provided with the cleaning device that removes and stores the residual toner from the surface of the photosensitive body after transfer. However, the present invention is suitably applicable to an image forming apparatus provided with the cleaning device that cleans the bearing member that bears the toner images such as the intermediate transfer body.

Further, in accordance with the embodiments described above, the color laser printer is exemplified as the image forming apparatus. However, the present invention is not limited to the color laser printer. It is of course possible to apply the invention to an electronic photographing copying machine, facsimile equipment, a wordprocessor, or other electronic photographing image forming apparatuses.

Also, as the transfer material serving as a recording material, it is possible to use recording paper sheets, OHP sheets or other plastic sheets, or cloths, among some others.

Although the present invention has been described with reference to the specific embodiments, it is not meant to be construed in a limiting sense. Various modifications of the disclosed embodiments, as well as other embodiments of the invention, will become apparent with reference to the description of the invention. It is therefore contemplated that the appended claims will cover any modifications as fall within the true scope of the invention.

What is claimed is:

1. A cartridge detachably attachable to a main body of an image forming apparatus, comprising:

a container for containing a toner cleaned from an image bearing body; and accumulating means for accumulating information associated with a count value of a counting operation effected every time an image formation operation is effected on a recording material after the toner contained in said container reaches a predetermined amount, wherein use of said cartridge is stopped on the basis of the information accumulated in said accumulating means, wherein the number of sheets of remaining recording material capable of having an image formed thereon from when the toner reaches the predetermined amount until the use of said cartridge is stopped changes in accordance with the number of sheets of the recording material on which image formation is effected in a first image formation mode from when the toner reaches the predetermined amount, and the number of sheets of the recording material on which image formation is effected in a second image formation mode from when the toner reaches the predetermined amount.

2. A cartridge according to claim 1, wherein said first image formation mode is a mode for forming a full color toner image on the recording material, and said second image formation mode is a mode for forming a monochromatic toner image on the recording material.

3. A cartridge according to claim 2, the number of sheets of the remaining recording material capable of having an image formed thereon from when the toner reaches the predetermined amount until the use of said cartridge is stopped decreases when the number of sheets of the recording material on which image formation is effected in said first image formation mode from when the toner reaches the predetermined amount increases.

4. A cartridge according to claim 1, wherein the count value is a sum of a first count value of the counting operation effected every time the image formation operation is effected on the recording material in said first image formation mode after the toner reaches the predetermined amount, and a second count value, different from the first count value, of the counting operation effected every time the image formation operation is effected on the recording material in said second image formation mode after the toner reaches the predetermined amount.

5. A cartridge according to claim 4, wherein the use of said cartridge is stopped when the sum of the first count value and the second count value becomes a predetermined value.

6. A cartridge according to claim 5, wherein the predetermined value is accumulated in said accumulating means.

7. A cartridge according to claim 1, wherein the image formation by said main body of said image forming apparatus is stopped on the basis of the information accumulated in said accumulating means.

8. A cartridge according to claim 1, wherein said main body of said image forming apparatus generates information for preparing an exchange of said cartridge when the toner reaches the predetermined amount.

9. A cartridge according to claim 1, wherein said accumulating means is a nonvolatile memory.

10. A cartridge according to claim 1, wherein said cartridge is provided with said image bearing body.

11. A cartridge according to claim 1, further comprising a cleaning portion for removing the toner from said image bearing body.

12. An image forming apparatus comprising:

an image bearing body;

a container for containing a toner cleaned from said image bearing body; and accumulating means for accumulating information associated with the number of sheets of recording material on which image formation is effected after the toner contained in said container reaches a predetermined amount, wherein a main body of said image forming apparatus generates information relating to a life of said container on the basis of the information accumulated in said accumulating means;

wherein the number of sheets of a remaining recording material capable of having an image formed thereon from when the toner reaches the predetermined amount changes in accordance with the number of sheets of the recording material on which image formation is effected in a first image formation mode from when the toner reaches the predetermined amount, and the number of sheets of the recording material on which image formation is effected in a second image formation mode from when the toner reaches the predetermined amount.

13. An image forming apparatus according to claim 12, wherein said first image formation mode is a mode for forming a full color toner image on the recording material, and said second image formation mode is a mode for forming a monochromatic toner image on the recording material.

14. An image forming apparatus according to claim 13, the number of sheets of the remaining recording material capable of having an image formed thereon from when the toner reaches the predetermined amount until the use of said container is stopped decreases when the number of sheets of the recording material on which image formation is effected in said first image formation mode from when the toner reaches the predetermined amount increases.

15. An image forming apparatus to claim 12, wherein the count value is a sum of a first count value of the counting operation effected every time the image formation operation is effected on the recording material in said first image formation mode after the toner reaches the predetermined amount, and a second count value, different from the first count value, of the counting operation effected every time the image formation operation is effected on the recording material in said second image formation mode after the toner reaches the predetermined amount.

16. An image forming apparatus according to claim 15, wherein the use of said container is stopped when the sum of the first count value and the second count value becomes a predetermined value.

17. An image forming apparatus according to claim 16, wherein the predetermined value is accumulated in said accumulating means.

18. An image forming apparatus according to claim 12, wherein the image formation on the recording material is stopped on the basis of the information accumulated in said accumulating means.

19. An image forming apparatus according to claim 12, wherein said main body of said image forming apparatus generates information for preparing an exchange of said container when the toner reaches the predetermined amount.

20. An image forming apparatus according to claim 12, wherein said accumulating means is a nonvolatile memory.

* * * * *

UNITED STATES PATENT AND TRADEMARK OFFICE

CERTIFICATE OF CORRECTION

PATENT NO. : 6,404,996 B1 
DATED : June 11, 2002
INVENTOR(S) : Tomonori Mori et al.

It is certified that error appears in the above-identified patent and that said Letters Patent is hereby corrected as shown below:

Column 2,
Line 37, "containing step a" should read -- a containing step --.
Line 58, "transferring step for a" should read -- a transferring step for --.
Line 64, "detect-" should read -- a detect- --.
Line 65, "a" should be deleted.

Column 3,
Line 1, "on" should read -- on a --.
Line 28, "Image" should read -- image --.
Line 34, "Image." should read -- image. --.
Line 35, "object" should read -- objects --.

Column 4,
Lines 3 and 32, "a the" should read -- a --.
Line 24, ".main" should read -- main --.
Line 43, "In" should read -- in --.

Column 5,
Line 36, "20Y,.20M," should read -- 20Y, 20M, --.
Line 66, "2OMS," should read -- 20MS, --.

Column 7,
Line 23, "means.20" should read -- means 20 --.

Column 8,
Line 40, "10 position" should read -- position --.
Line 63, "a the" should read -- a --.

Column 9,
Line 21, "10" should be deleted.
Line 43, "a the" should read -- a --.
Line 59, "mechanism." should read -- mechanism --.
Line 60, "the." should read -- the --.

Column 10,
Line 42, "a" the should read -- a --.

UNITED STATES PATENT AND TRADEMARK OFFICE

CERTIFICATE OF CORRECTION

PATENT NO. : 6,404,996 B1 
DATED : June 11, 2002
INVENTOR(S) : Tomonori Mori et al.

It is certified that error appears in the above-identified patent and that said Letters Patent is hereby corrected as shown below:

Column 11,
Line 32, "hundreds" should read -- hundreds of --.

Column 12,
Line 1, "dram" should read -- drum --.

Column 13,
Line 10, "the longer" should read -- a longer --.
Line 48, "the." should read -- the --.
Line 49, "value." should read -- value --.

Column 14,
Line 26, delete "as".
Lines 53 and 54, "brash," should read -- brush, --.
Line 57, "upon on," should read -- upon --.

Column 15,
Line 60, "claims 2," should read -- claim 2, wherein --.

Column 16,
Line 60, "claim 13," should read -- claim 13, wherein --.

Signed and Sealed this

Twenty-fifth Day of February, 2003

JAMES E. ROGAN
*Director of the United States Patent and Trademark Office*